US005515297A

United States Patent [19]

Bunting

[11] Patent Number: 5,515,297

[45] Date of Patent: May 7, 1996

[54] OIL BURNER MONITOR AND DIAGNOSTIC APPARATUS

[76] Inventor: John E. Bunting, 75 Scobie Rd., New Boston, N.H. 03070

[21] Appl. No.: 224,852

[22] Filed: Apr. 8, 1994

Related U.S. Application Data

[63] Continuation-in-part of Ser. No. 136,804, Oct. 14, 1993, abandoned.

[51] Int. Cl.[6] ..... G01B 7/00

[52] U.S. Cl. ..... 364/551.01; 364/550; 431/13; 431/14; 431/18; 431/66

[58] Field of Search ..... 364/551.01, 550, 364/494, 505; 431/16, 78, 13–15, 17, 18, 20, 24, 27, 28, 42, 43, 45–46, 48, 66, 67, 77, 78; 73/112; 165/11.1; 236/1 A, 1 H, 1 G, 11, 37, 44.3, 94, 70, 4 R, 46 R, 15 BR

[56] References Cited

U.S. PATENT DOCUMENTS

| | | | |
|---|---|---|---|
| 4,373,662 | 2/1983 | Bassett et al. | 364/505 |
| 4,381,075 | 4/1983 | Cargill et al. | 237/8 R |
| 4,455,095 | 6/1984 | Bleiker | 364/505 |
| 5,063,527 | 11/1991 | Price et al. | 431/24 |
| 5,197,664 | 3/1993 | Lynch | 431/18 |
| 5,249,739 | 10/1993 | Bartels et al. | 431/78 |
| 5,277,575 | 1/1994 | Newberry | 431/24 |
| 5,307,990 | 5/1994 | Adams et al. | 236/11 |

*Primary Examiner*—Emanuel T. Voeltz
*Assistant Examiner*—Hal D. Wachsman
*Attorney, Agent, or Firm*—William B. Ritchie

[57] ABSTRACT

An oil burner operation monitoring apparatus for enabling convenient diagnosis of burner problems. The device is connected to key points in the oil burner. The device records and stores information concerning the key functions indicative of an oil burner's operation. If a fault occurs, the apparatus generates a signal to indicate to a downstream microprocessor, if such is connected, that a problem has occurred. The oil burner technician can access the invention for the information concerning the reason for the problem. This eliminates the need for the technician to randomly replace parts until the problem is located. The system monitors the status of the thermostat; the presence and the level of voltage powering the ignition transformer and temperature on the outside of the vent stack pipe. The device also provides a signal in the event of a fault that can be connected to a downstream microprocessor that, in turn, can activate various warning devices.

7 Claims, 13 Drawing Sheets

FAULT DETECTED ROUTINE #5

ERASE MEMORY
ROUTINE #7

CONFIGURE
ROUTINE #8

OIL BURNER MONITOR AND DIAGNOSTIC APPARATUS

This application is a continuation-in-part of U.S. application Ser. No. 08/136,804, filed Oct. 14, 1993, now abandoned.

BACKGROUND OF THE INVENTION

1. Field of the Invention

The invention relates to diagnostic tools for oil burners.

2. Description of the Related Art

There is a need to log events that occur during the operation of an oil burner when there is an intermittent problem that causes the oil burner primary control to cycle to a safety standby condition.

Presently, the only method for a repair technician to diagnose and repair such an intermittent problem is to replace one part of the oil burner system each time there is a malfunction.

Occasionally, proper operation of an oil burner is interrupted by an intermittent condition that causes the burner to go to a condition, variously called safety standby, safety lockout, or to "go out on safety." When this occurs, manual resetting of the oil burner primary control by either the resident or a service technician is required. This condition can be caused by a faulty part in the oil burner, a faulty oil burner primary control, fuel delivery problems, or an improper voltage condition on the line powering the ignition transformer.

When the service technician arrives, the intermittent condition causing the safety lockout may or may not be still present. The oil burner may operate satisfactorily for several days, only to go to a safety lockout again, when the intermittent condition reoccurs. This frustrating sequence can occur several times as presently the only method of diagnosis and repair available is to replace one part after another and wait to see if the problem reoccurs again. This can be several days or weeks later. Throughout this period, the resident of the property is unsure whether the heating system of the building is reliable and whether any absence coincidental to such an occurrence will result in significant damage to the building due to freezing conditions.

U.S. Pat. No. 5,063,527, issued to Price et al. on Nov. 5, 1991, discloses a monitoring system directed to controlling safety aspects of burners. This is done by referencing real time conditions relative to reference standards. The system does not disclose or suggest the need for monitoring an historical record of operation or the necessary structure to accomplish such monitoring.

U.S. Pat. No. 5,005,142, issued to Lipchak et al. on Apr. 2, 1991, discloses a sensor system for communicating to a control section which compares the signals to a standard and then sounds a warning if there is significant deviation.

A system that logs the data history of residential oil burners, accurately recording the history of events as they occurred so that the record can be viewed for diagnosis of the problem is not taught in the prior art.

SUMMARY OF THE INVENTION

It is the object of the invention to provide a device that monitors changes in the status of certain functions of an oil burner system and conditions present, those being specifically: 1) the status of the thermostat, 2) the presence of, and 3) the level of voltage powering the ignition transformer, and 4) the temperature on the outside of the vent stack, in order to permit a repair technician to monitor those events, recall past events and diagnose intermittent problems that might not be duplicated when the repair technician is present.

It is another object of the invention to provide a hand-held device capable of monitoring changes in key oil burner functions.

It is still another object of the invention to provide a device that utilizes a microprocessor to permit monitoring several channels of inputs of information from an oil burner system, process that information, store that information with the time, and make that information accessible at a later time in an economical way.

It is still another object of the invention to provide immediate feedback of the monitored events by displaying changes in their condition on the integral display screen as they occur in order to permit a repair technician to monitor those events in real-time.

It is still another object of the invention to provide a device that will: 1) record changes in the status of critical events during the operation of oil burners; 2) store the recorded events with time and date in solid state, non-volatile memory for later review.

It is still another object of the invention to provide a device capable of determining when a fault condition has occurred in the proper operation of an oil burner by comparing whether the thermostat or aquastat is signaling for the oil burner to operate and whether there is voltage present at the ignition transformer primary leads, and cause another piece of equipment to be activated in order to alert a responsible party of such a fault condition.

It is still another object of the invention to provide a keypad for the oil burner service technician to access information stored in the non-volatile memory and s thereby aiding in the determination of what anomaly in the operation of the oil burner caused the fault condition and permit the proper corrective action to be taken.

It is still another object of the invention to utilize a EEPROM (electrically erasable programmable read only memory) chip to preserve data to minimize the possibility of data being lost if the device is unintentionally powered-down, so that the repair technician will have the greatest likelihood of determining the cause of the oil burner problem.

It is still another object of the invention to utilize a step-down transformer attached to the 120 volt AC leads of the oil burner ignition transformer so that only low voltages are present in the invention to minimize the possibility of electrical shock to persons who might come into contact with the device.

It is still another object of the invention to interpolate the AC voltage available to the oil burner ignition transformer from the reduced voltage of the step-down transformer in order to determine if, at a minimum, 110 volts AC is available at the ignition transformer, such voltage being necessary in order for that transformer to operate effectively.

It is still another object of the invention to provide a power-down circuit for the central processor unit to minimize the possibility of data being lost if power is unintentionally lost to the device.

It is still another object of the invention to provide sufficient information on the integral display screen to allow complete operation of the unit without the need for an instruction manual.

It is another object of the invention to allow certain monitor functions to be disabled so that the device can be utilized on a variety of oil burner systems.

It is another object of the invention that vent stack temperature readings are taken from the outside surface of the vent stack pipe utilizing a thermistor that attaches to the outside of the vent stack using existing components of the vent stack system.

It is another object of the invention that, when a fault condition has been determined to have occurred, the device will cease gathering any further data and, with the exception of intentionally erasing stored data, there is no operational way to lose the remaining data.

It is the final object of the invention to provide an intelligent port to allow the central microprocessor to communicate with other "downstream" microprocessors to allow the monitoring of other functions of the oil burner system and to allow for auxiliary functions to be developed at a later date.

The invention is a monitor and diagnostic apparatus for an oil burner having a thermostat or aquastat (herein both are referred to as thermostat), an ignition transformer and a vent stack. First sensing means is provided for producing a first signal corresponding to the voltage at the thermostat connection of said oil burner. Second sensing means is provided for producing a second signal corresponding to the voltage at the ignition transformer of said oil burner. Third sensing means is provided for producing a third signal corresponding to the temperature of the vent stack. Central processing means is provided for processing the first, second, and third signals from said first, second and third sensing means, respectively. The processing means provides an output corresponding to the operational history of said oil burner over a pre-selected time interval. Memory means for recording the output of said central processing means that corresponds to the operation history of said oil burner over a pre-selected time interval is also provided. Display means for displaying the recorded output of said memory means is also provided. Display means for displaying the recorded output of said memory is provided. A user of said apparatus can determine the operational history of said oil burner over a pre-selected time interval by viewing said display means.

DETAILED DESCRIPTION OF THE INVENTION

Figure 1:
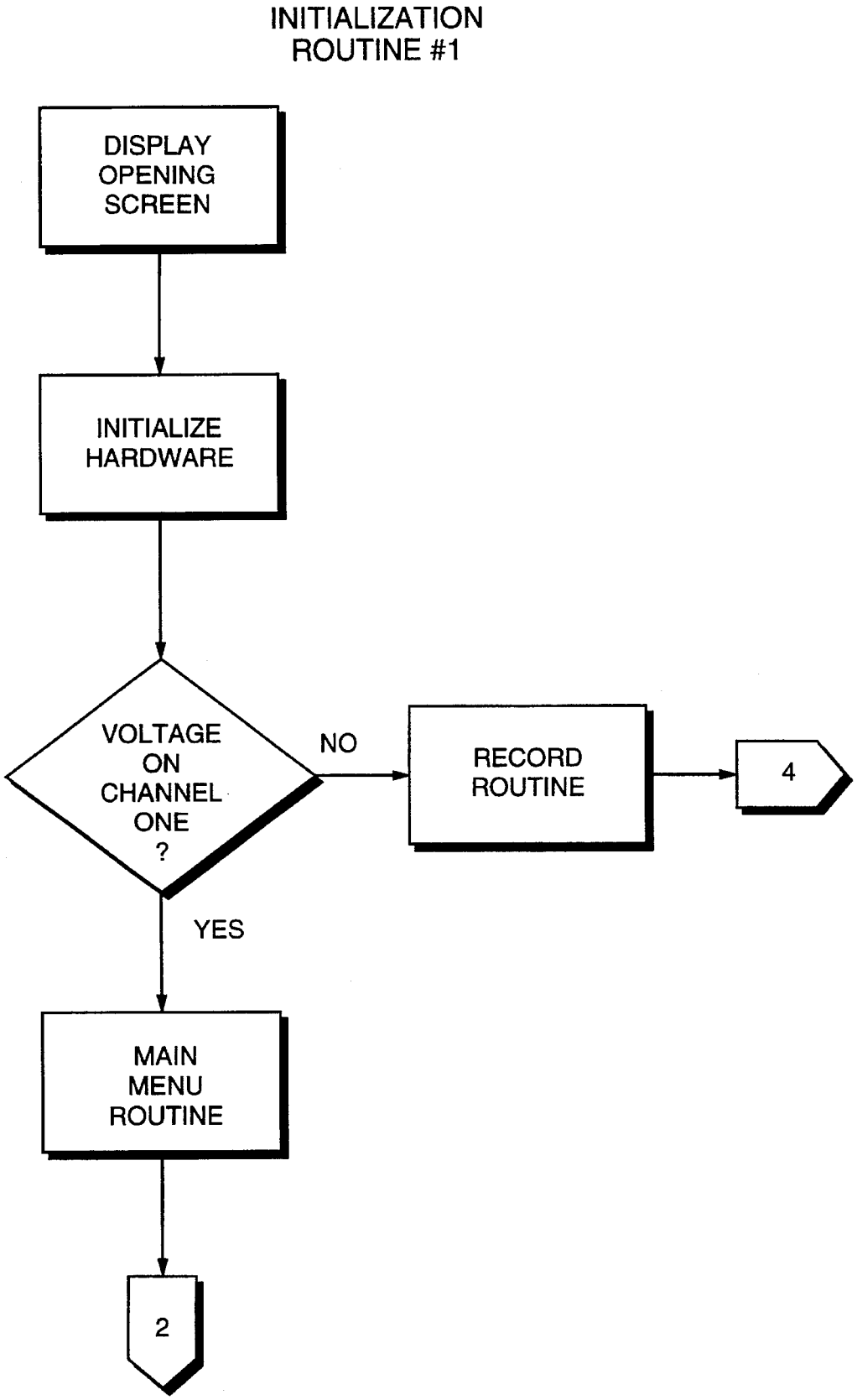
FIG. 1 is a flow chart illustrating the initialization operation of the apparatus.
Figure 2:
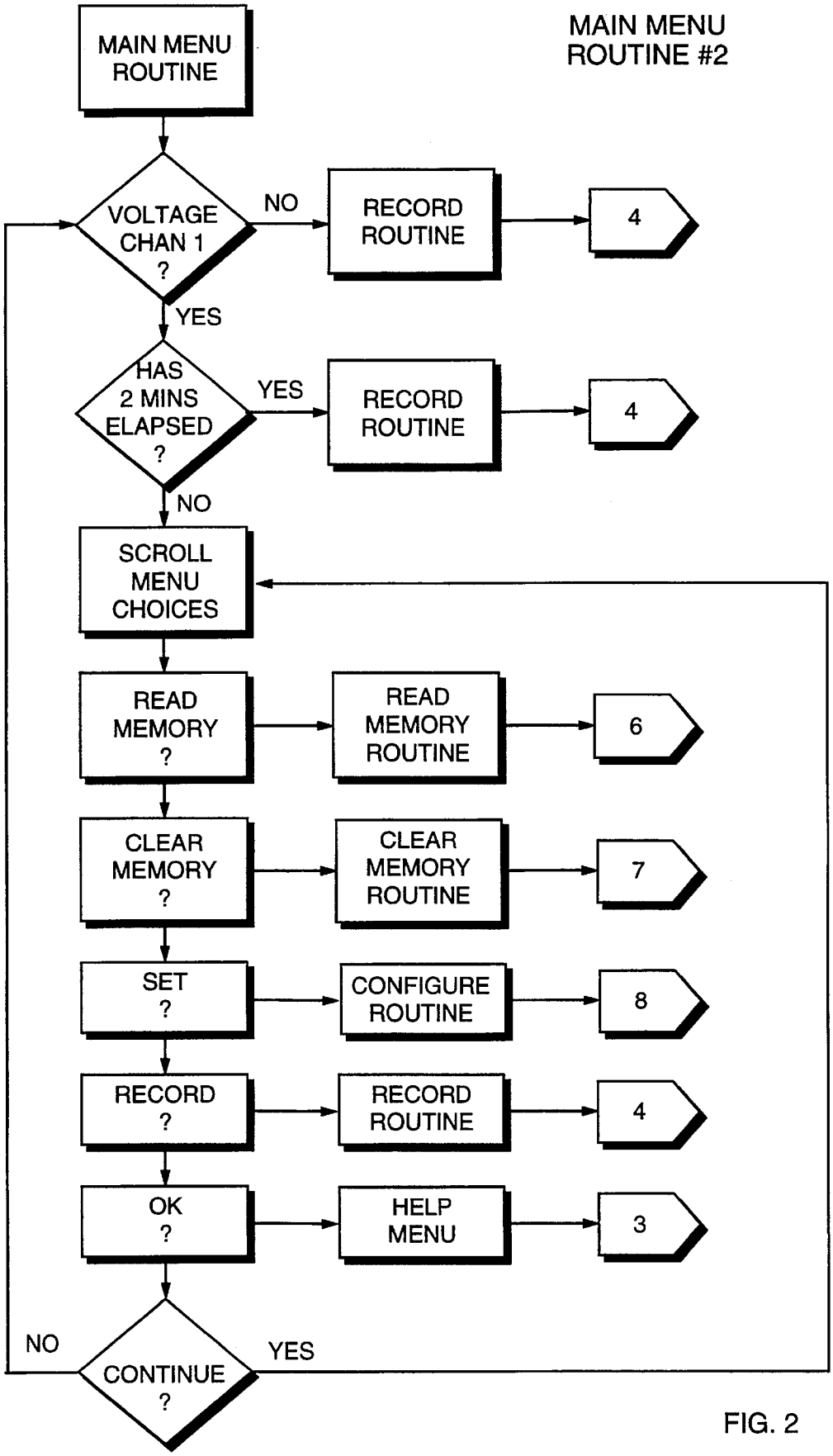
FIG. 2 is a flow chart illustrating the main menu operation of the apparatus.
Figure 3:
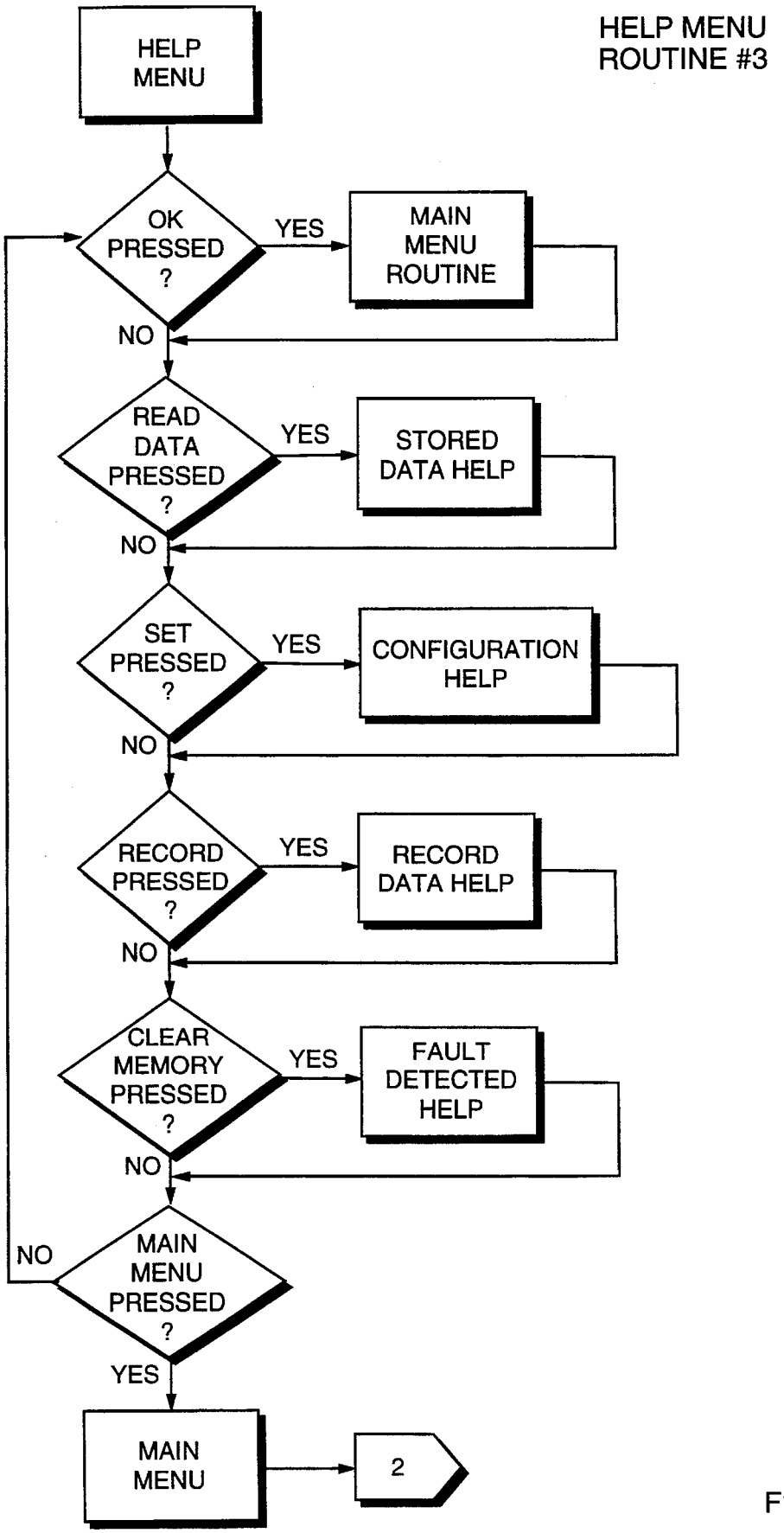
FIG. 3 is a flow chart illustrating the connections menu operation of the apparatus.
Figure 4:
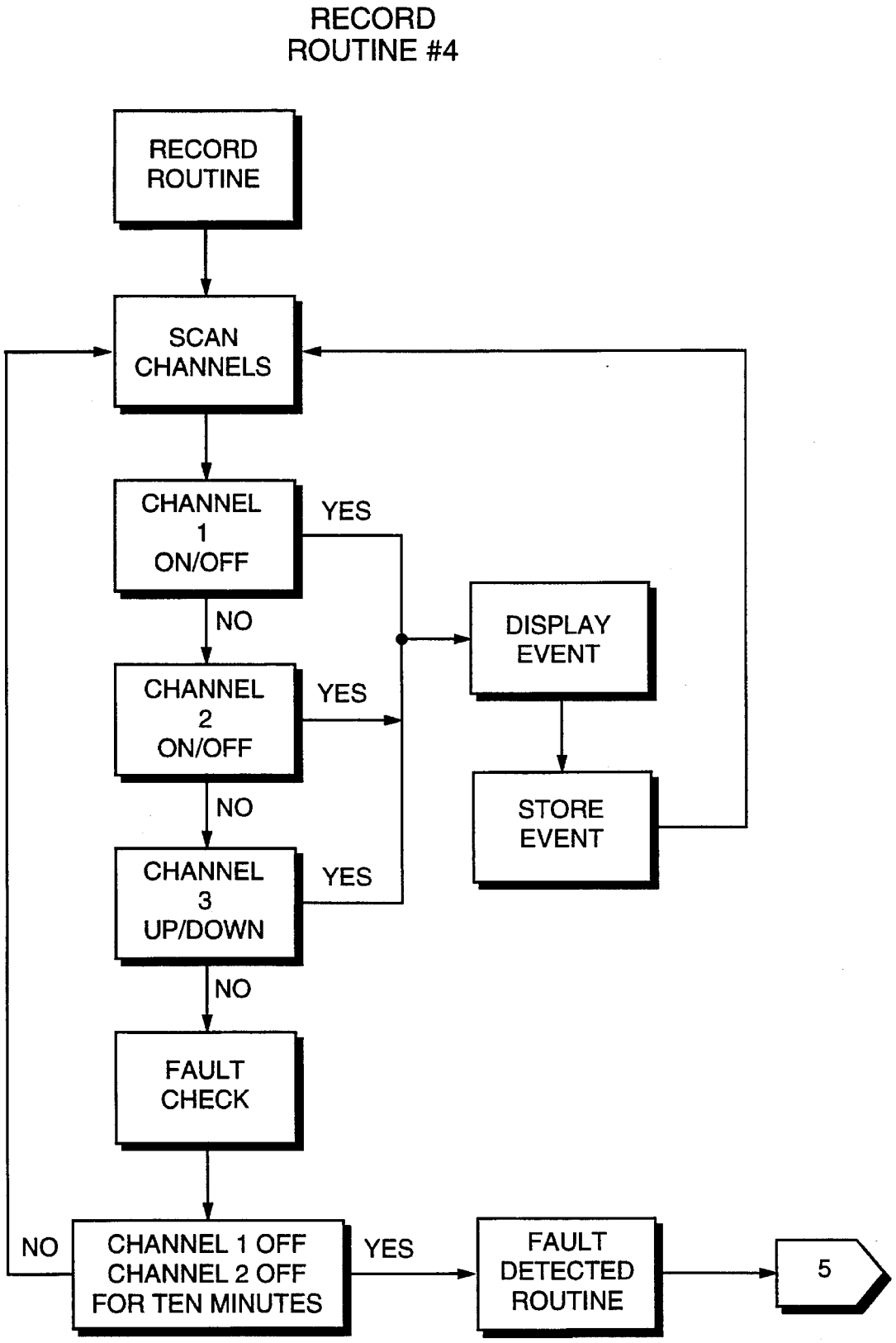
FIG. 4 is a flow chart illustrating the record operation of the apparatus.
Figure 5:
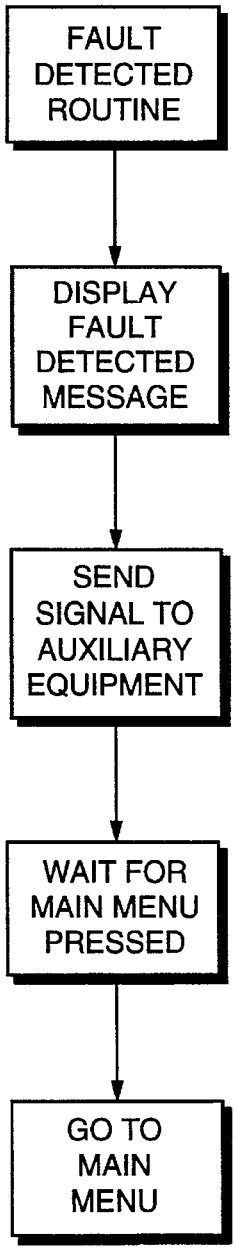
FIG. 5 is a flow chart illustrating the fault detection operation of the apparatus.
Figure 6:
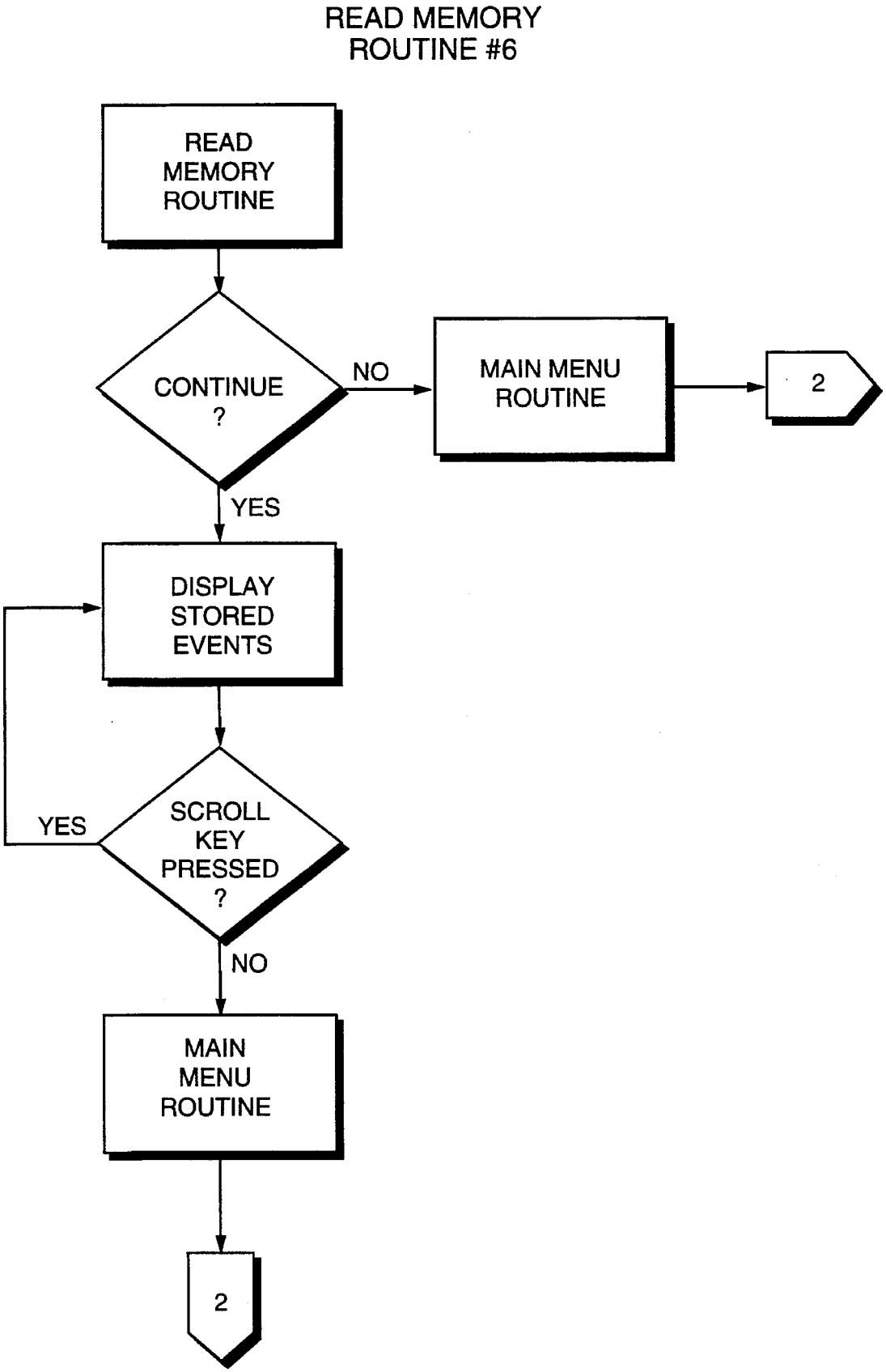
FIG. 6 is a flow chart illustrating the read memory operation of the apparatus.
Figure 7:
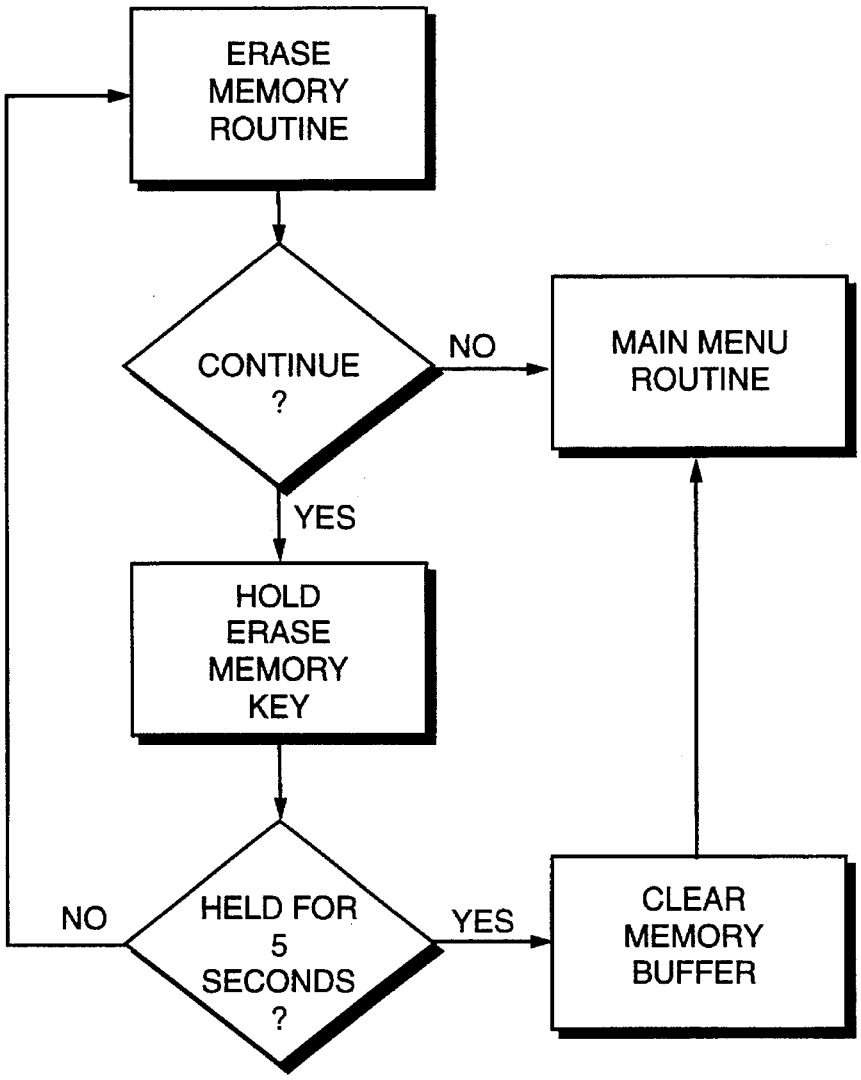
FIG. 7 is a flow chart illustrating the inactivity operation of the apparatus.
Figure 8:
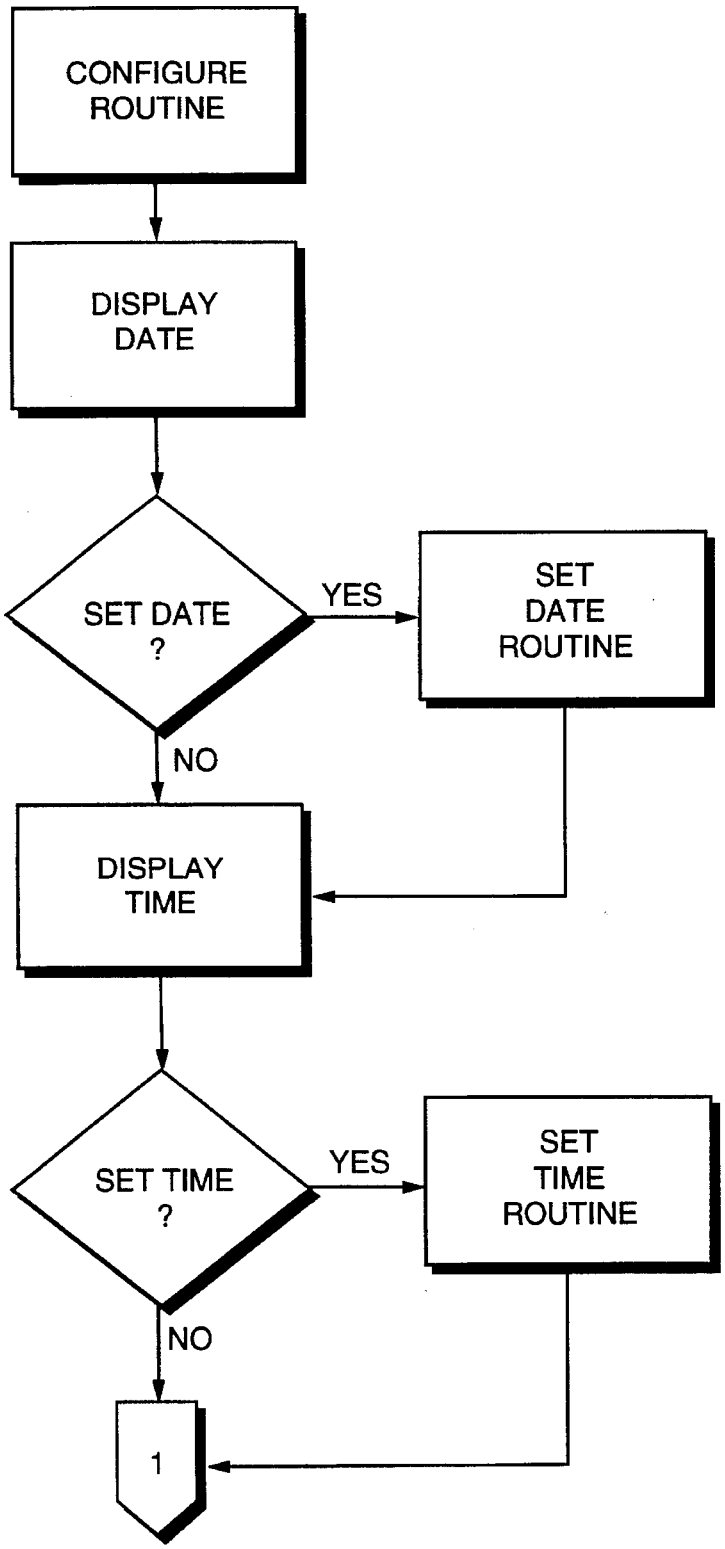
FIG. 8 is a flow chart Illustrating the erase memory operation of the apparatus.

The invention is a monitor and diagnostic data logging apparatus that will record a sequence of relevant events and store that information with the time in non-volatile memory, and will also determine when a fault condition has occurred in the oil burner, By using this monitor and diagnostic data logging apparatus, the oil burner repair technician can review the logged events and determine what part of the oil burner system malfunctioned or if the line voltage was too low and make the correct repair on the first service call after the unit is installed.

When such a fault condition occurs, an appropriate signal will be sent through the auxiliary intelligent port to an optional downstream microprocessor which can activate another piece of equipment to alert a responsible party. When the service technician responds, he/she will be able to retrieve, through the controls provided on the integral keypad, and read the stored data on an integral LCD display to aid in determining what caused the oil burner to "go out on safety," i.e. what caused the fault. This will allow a completed repair on the first service call after the device is installed.

OPERATION OF THE INVENTION

The invention is a device designed to monitor several electrical and one temperature condition on an oil burner, record changes in their conditions, identify these changes with time, and store that data in non-volatile memory. Additionally, if certain conditions exist, the device will make a determination that a "fault condition" has occurred, will indicate so on a screen and provide a means of activating another device to notify personnel. The information stored in non-volatile memory will be available for review on a screen and will allow a trained technician to review the events leading up to the "fault condition" and aid in determining the likely cause.

The apparatus is connected to several points of an oil burner system. It will record the important events that occur during the operation of an oil burner. It will log what occurred, along with the time, and store that information in non-volatile memory which can be accessed by a repair technician at a later time. It will also determine, through software, when a fault condition has occurred in the oil burner and, through communication with a down-stream microprocessor connected to a jack, activate another piece of equipment which will alert a relevant person.

The device features an Intel 80C188EB central processor unit (CPU) microprocessor which receives instructions from an EPROM. The CPU receives information from three channels (or inputs) which are connected to various points on an oil burner system. The CPU processes the information, displays it on the integral display, and stores the information in the non-volatile memory. This stored information is available by manipulating the integral keypad and then can be visualized through the integral display.

The apparatus uses software which, when the unit receives power and if so desired, will guide the repair technician step-by-step through the set-up and connection procedure so that an instruction manual is not necessary.

Figure 9A:
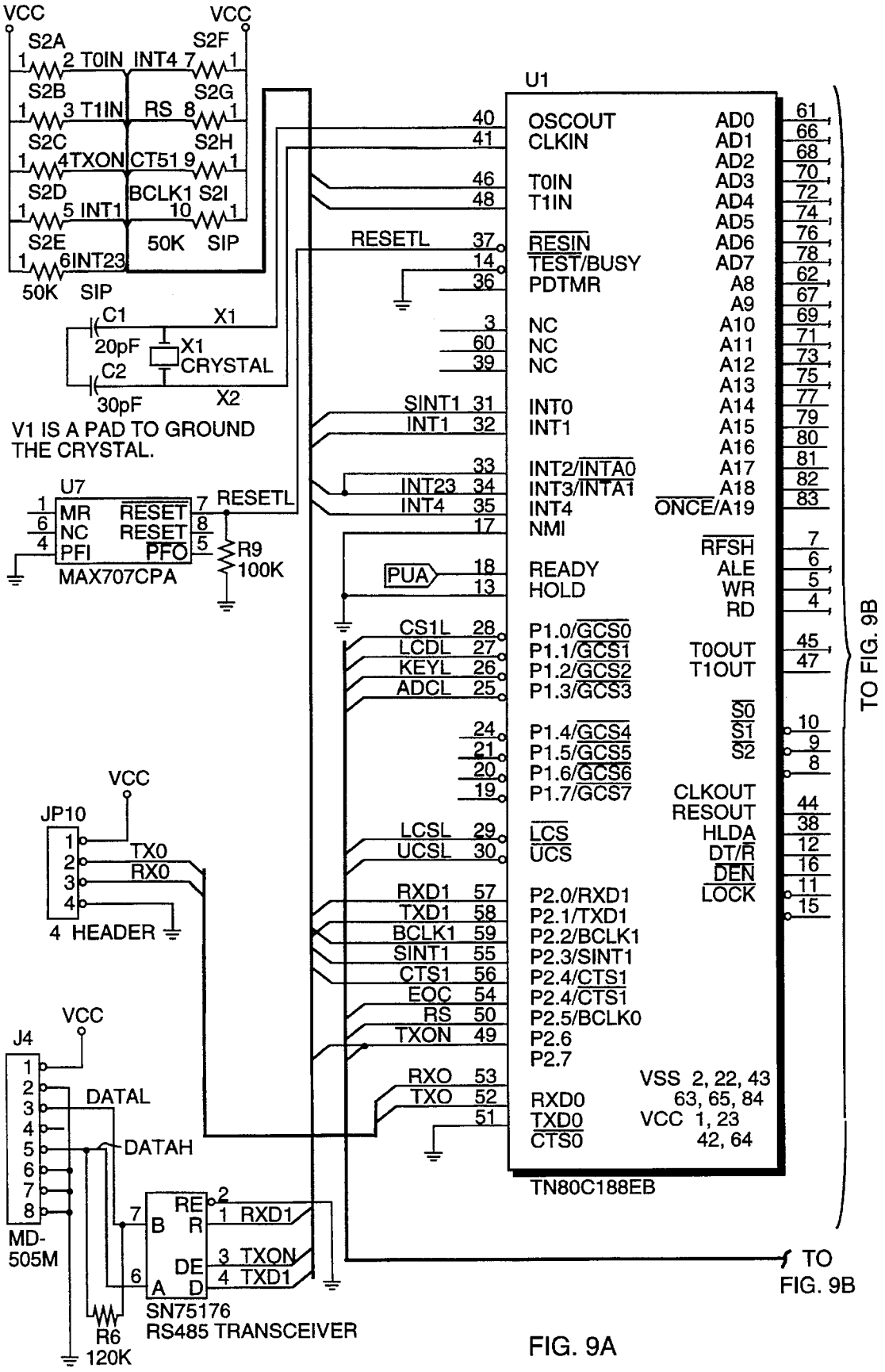
FIGS. 9A–9E are a schematic of the oil burner data logging apparatus in accordance with the invention.
Figure 9B:
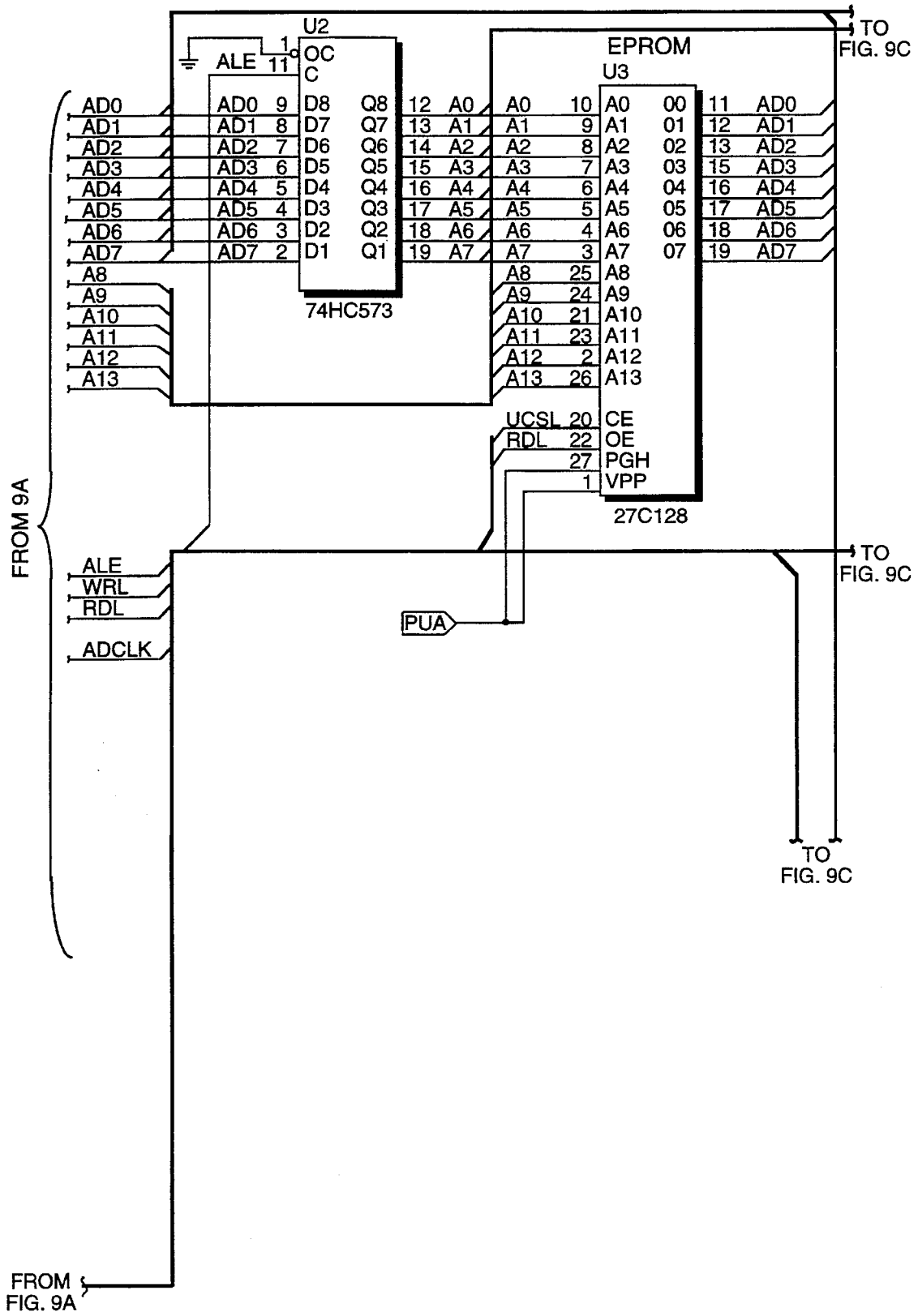
Figure 9C:
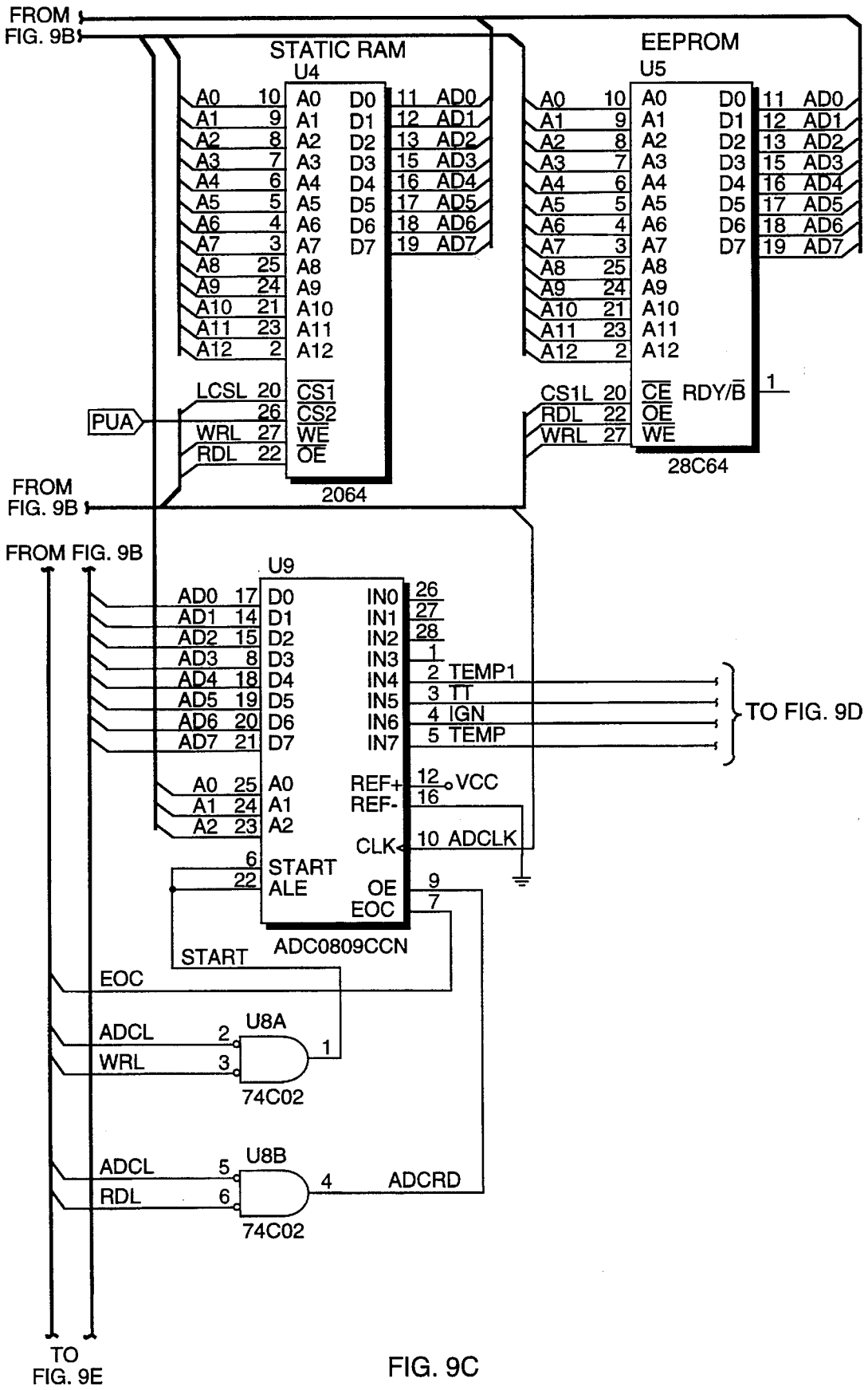
Figure 9D:
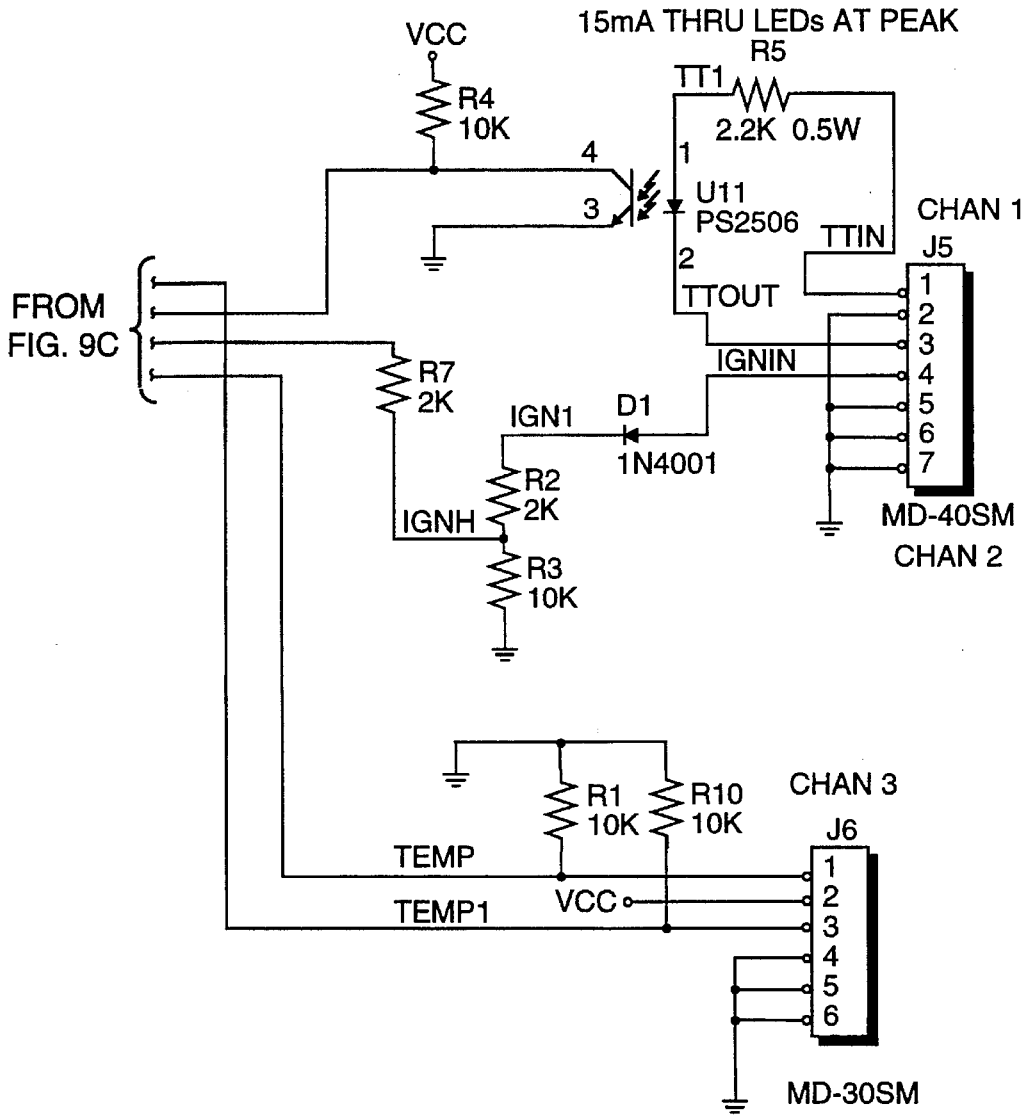
Figure 9E:
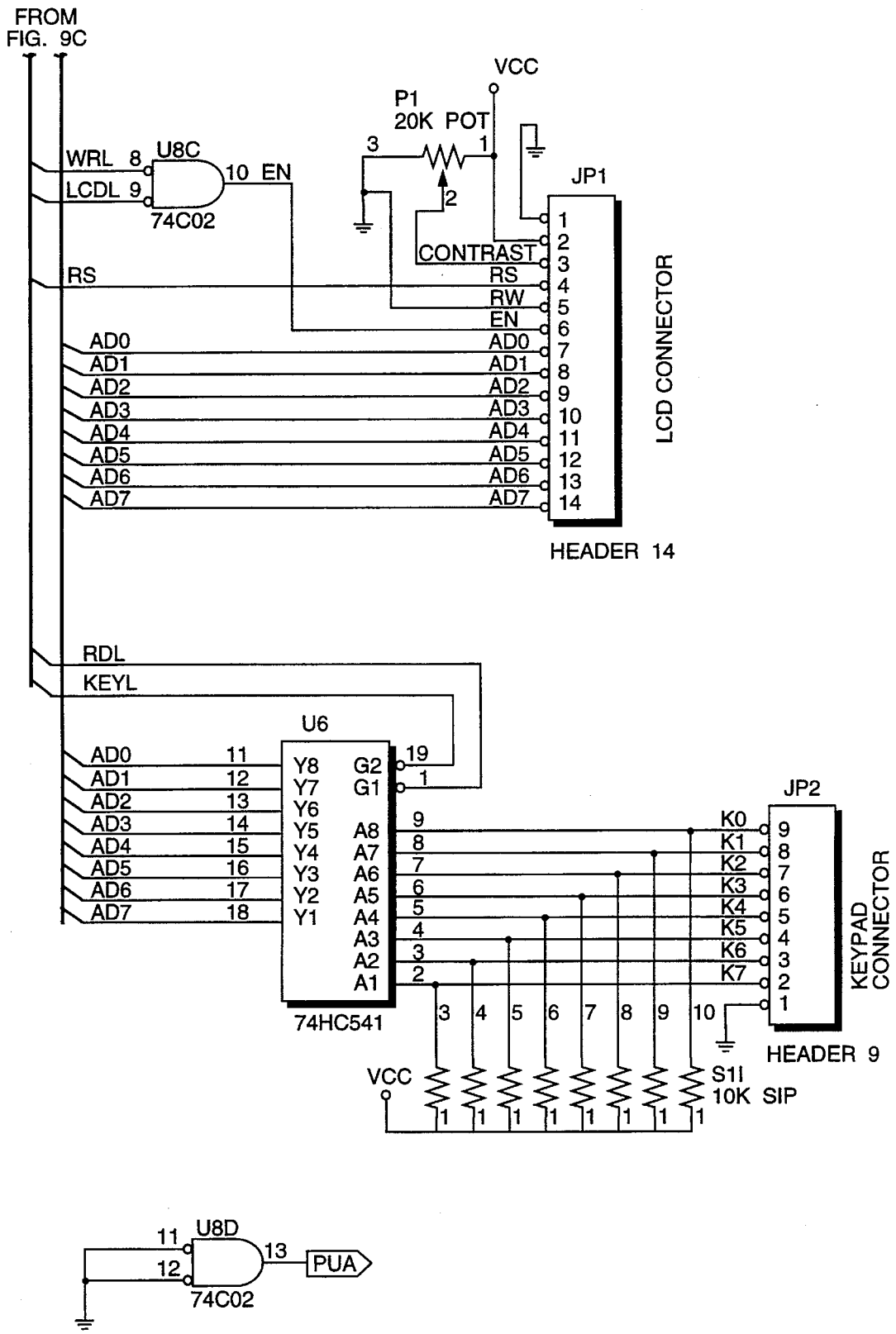

The apparatus, through Channel 1, monitors activation and deactivation of the oil burner primary control by the thermostat or aquastat and records the event with the time into EEPROM. Specifically this is done by monitoring the presence or absence of 24 or more volts AC at the thermostat connections of the oil burner primary control. This voltage is received through Jack 5 or input CHAN 1, as shown on FIG. 9B.

The apparatus, through Channel 2, monitors the activation and deactivation of the oil burner ignition transformer by the oil burner primary control and records the event with the time into RAM. Specifically, this is done by measuring the presence or absence of AC voltage at the secondary terminals of a 110 to 3.3 volt step-down transformer that will be connected to the primary wires of the ignition transformer. This voltage is received through input CHAN2, as shown on FIG. 9.

The apparatus measures, through Channel 2, the line voltage, Voltage A, present at the ignition transformer primary windings by measuring the voltage present at the secondary windings of the step-down transformer, Voltage B. Voltage B is sampled periodically during a 5 second period for the first 50 seconds after the activation of Channel 1. If Voltage A is below 110 volts AC, then Voltage B at the secondary windings of the step-down transformer will be below 3.3 volts AC. Voltage B will then, through software, be interpolated back to the original voltage, Voltage A, and these readings will be stored by the CPU in non-volatile memory with the time.

The apparatus monitors, on Channel 3, a thermistor attached to the outside of the vent stack of the oil burner. The CPU measures the resistance of the thermistor once every 5 seconds for the first 50 seconds after the activation of Channel 1. A change in resistance reflects whether the temperature is rising or falling in the vent stack. The CPU compares the resistance reading of the thermistor and, through a "look-up table" contained in the EPROM, determines what the temperature of the vent stack is and records that information with the time in RAM. The thermistor is connected to Jack J6.

The apparatus further samples the information received on Channels 1 and 2. If Channel 1 is recorded as having 2.5 or less volts AC continuously for 10 minutes and if, during that same time, Channel 2 does not have 50 or more volts AC, then the software declares that a fault condition has occurred and the equipment branches to the Fault Condition subroutine which causes the recording of events to cease and a signal is sent, through Jack J4 to any downstream microprocessor, which can cause s another piece of equipment to activate that will alert a responsible person.

The service technician can, by operating the controls on the integral keypad on the apparatus, display the information stored in the non-volatile memory. The information will be displayed in plain language on the LCD display screen. By reviewing the stored information, the sequence of events for Channels 1–3 can be examined, and the repair technician can likely determine what part malfunctioned or if the line voltage was too low causing the fault condition to occur.

The apparatus, as described above and as shown in FIG. 1, contains a data logging circuit with a CMOS computer, various power control circuitry, a keypad, an LCD display, and I/O conditioning circuitry to monitor the various inputs as described above.

The CMOS computer section has several components. U1, an 80 C188EB microprocessor, which is available from Intel. This processes the software and the information received from the inputs.

The crystal, X1, is a 16 MHz crystal. It is a parallel resonant crystal that provides input to the microprocessor.

The EPROM, which is U3, is a 27C256, which is a 32K×8 byte EPROM, available from SGS Thompson.

The RAM, U4, is an 8K by 8 static RAM, 8464A, available from Fujitsu.

The EEPROM, U5, is a 28C64, 8K×8 electrically-erasable programmable read-only memory, available from Atmel.

U2, which is an address latch, is a 74HC573, which is available from SGS Thompson. Since the 80 C188EB has a multiplex address databus, it is necessary to de-multiplex the address from the data, and that is the purpose of U2.

U9, an ADC0809CCN, is an analog to digital (A/D) convertor, available from National Semiconductor. This is an 8 channel ratiometric convertor.

The next devices are for logic. U8, a 74CO2 NOR GATE, ties in the logic necessary for the ADC0809, which is not Intel-based. It has four NOR GATES in the package. The first, U8A, is used to combine the ND chip select and the write signal to produce a starting post for the A/d conversion.

U8B uses the chip select from the microprocessor along with the read line to read the data that was converted from the A/D.

U8C uses the write signal from the microprocessor as well as the chip select from the microprocessor to provide the enable line for the LCD.

U8D, the last NOR GATE, is used to pull up signals that require a high input, for example the static RAM and the EPROM.

U7, a MAX702CPA available from Maxim, is a chip used to produce the reset for the microprocessor. As well as producing a reset on power-up and power-down, detecting power failure, it also, with two resistors and a voltage divider, can produce a power fail output.

U12, a RS485 driver using a MAX487CPA transceiver, available from Maxim, is used for the auxiliary output to communicate with any downstream microprocessors. It meets all the EIA 485 interface codes and communicates through J4 to any downstream microprocessors.

The power circuit receives 9 volts DC through Jack J3. That power goes through the switch SW1, and feeds two regulators, U13 and U10. One feeds power to the microprocessor and the other feeds power to the LED backlight of the LCD as well as the auxiliary output, J4. U13 and U10 are both LM7805, available from National Semiconductor. The power-in circuit is protected by diodes, D3 and D4, so that if there is reverse polarity received at J3, the board will not be damaged. Also the regulators are protected from short circuits on the input lines.

JP 10 is a 4-pin connector that is used as a serial port for U1 and is available for future use.

Jack J6, a 3-pin connector, is used for the thermistor input for stack temperature. This uses 2 pins of the connector, J6, one being common. The remaining pin of J6, along with the common, is available for future use. The thermistor is wired as a voltage divider.

J5, is a 4 pin connector. It is used to connect to the thermostat and the ignition transformer inputs. Pins 1 and 3 are used to monitor the output voltage at the thermostat connections of the oil burner primary control. This can be up to 24 volts AC. This signal is received, going through a 2.2K ½W current limiter which is connected to an opto-isolator, U11, a PS2506, available from NEC.

Pin 4 of J5 receives the reduced voltage from the step-down transformer, which is connected to the primary leads of the ignition transformer, through a diode and then through a voltage divider. This voltage is fed to U9, the ND convertor. After processing by U1, 3.3 volts AC from the step-down transformer translates to 110 volts AC at the line connection of the oil burner ignition transformer. Other received voltages are interpolated by U1 to reflect the original voltage at the primary leads.

Jack J4 is the Auxiliary Port which can communicate with other downstream microprocessors. Pin 1 on J4 is VCC, Pin 2 is ground, Pin 3 is the positive data output and Pin 5 is the negative data output. Pin 4 is reserved for future use.

J11 is a connector to supply voltage to the LED backlight of the LCD. The LCD is available from Optrex and is a model DMC16202-LY-NY-1, and has an LED backlight. It is connected to JP1.

The keypad is a proprietary 8-key keypad with a common line. It is connected to JP2. It is fed into U6 which is a 74HC541 buffer. It is controlled by the microprocessor. U6 is available from Toshiba.

All program code is contained within the EPROM, U3. U3 contains two application programs. One is the BIOS, which is the basic input/output system. The other is the application code. Upon power up, the BIOS is run from the EPROM. It sets up the microprocessor, every address for the chip selects, tells the microprocessor where the RAM is located, where the EPROM and the EEPROM are located. It also tells the microprocessor where the A/D convertor is located and the keypad and keypad buffer. It also sets up all the hardware interrupts from the A/D convertor, the serial ports, the software interrupts to communicate with the RS 485, the interrupts for the internal buffers, as well as having a debug program to use for Channel 0 serial input.

Once everything is properly set up, configured, the EEPROM is tested and passes, then it goes to the application program. It first initializes the LCD display to make sure it is receiving information. It sets up the interrupt for the internal timer, which is a 10 millisecond interrupt. It also sets up another timer for delays that are needed in the program. Then it sends a message to the LCD and starts the program.

After the title screen is displayed, the program waits in MAIN MENU until the operator makes a choice by way of the integral keypad. If no choice is selected within two minutes, the program branches directly to the RECORD routine, described below. The MAIN MENU has several branches to other routines.

If the MAIN MENU key is pressed within the 2 minutes, nothing happens because the program is already in MAIN MENU.

If the OK key is pressed, the program branches to the HELP subroutine, which provides several choices to the operator in receiving additional information on operating the device.

If the READ DATA key is pressed, it branches to the READ DATA routine which allows the operator to read the data which has been logged into the EEPROM. By manipulating the scroll keys and viewing the LCD display, the operator can access the stored data. The data is stored in the EEPROM in a structure that is circular, and the first data available through the scroll keys is either the most recent data or the oldest. If the operator pushes the FORWARD scroll key, the oldest data will be shown. If the operator pushes the BACKWARD scroll key, the newest data will be shown. From the READ DATA routine, if the MAIN MENU key is pressed, the program returns to the main menu.

From the MAIN MENU, if the SET key is pressed, the program branches to a routine that allows the device to be configured. The configure routine allows the time to be set and also permits the operator to deselect any inputs so that they will not be recorded. This allows the unit to be used on certain brands of oil burners. After all the options are chosen, the last screen of the configure routine is a status screen which informs the operator of what the time is and whether any inputs have been deselected. The MAIN MENU key returns the program to the MAIN MENU routine.

From the MAIN MENU, if the CLEAR MEMORY key is pressed, the program branches to the CLEAR MEMORY routine. This routine first asks the operator to confirm the choice by pressing the OK key. If the OK key is pressed, then the operator must hold the CLEAR MEMORY key for 5 continuous seconds and then the top and bottom pointer in the EEPROM is reset, which mimics having all the data erased.

From the MAIN MENU if the operator pushes the RECORD key, the program branches to the RECORD routine. At the start of this routine, the MAIN MENU button of the keypad and the thermostat voltage are constantly monitored. In this routine, the program reads the presence or absence of a 24 volt signal from the thermostat connections of the oil burner primary control, after that voltage goes through the opto-isolator, U11 and the A/D, U9. The microprocessor takes 64 samples and averages them and determines whether they are greater or less than 2.5 volts. This is to flatten out any spikes. Less than 2.5 volts indicates that the thermostat is in an ON condition, and 2.5 or more volts indicates that the thermostat is in an OFF condition.

When the microprocessor detects that the thermostat is ON, the time is recorded in the EEPROM along with the message THERMOSTAT ON. The program then goes to another routine that is constantly monitoring the oil burner ignition transformer voltage, which is Channel 6 of the ND convertor, U9. At the same time it is still monitoring the thermostat and the key pad. If the ignition transformer voltage is turned on within 10 minutes of the thermostat going on, then it is recorded as IG TRANSFORMER ON along with the time and voltage. If, within the ten minute period, the thermostat does not go off (i.e. voltage does not go above 2.5 volts), the main menu button is not pressed, nor does the ignition transformer voltage go on, then the program branches to the FAULT DETECTED routine.

The FAULT DETECTED routine causes all further data recording to cease, a message to be displayed on the LCD, and a signal is sent through J4 to any connected downstream microprocessor indicating that a fault has been detected.

When the thermostat goes on and the ignition transformer does go on, then the program branches to another routine that records the voltage at the primary leads of the ignition transformer and the vent stack temperature every 5 seconds for 50 seconds. Between every reading, the ignition transformer voltage is constantly being monitored and the lowest voltage within that 5 second period is then recorded. The subroutine uses the four lowest voltage readings, averages them, and uses that as the lowest voltage reading for the 5 second period. During this time, at the 5 second point, the resistance of the thermistor is read. 128 resistance readings are taken as fast as possible, then they are summed and an average is taken, which then becomes the resistance reading. The thermistor is a 100K ohm thermistor, which means that the input volt ranges from 0.5 volts to 4.5 volts, corresponding to a range of −30 degrees to 430 degrees F. at the surface of the vent stack pipe. The program takes this resistance reading and compares it to a lookup table contained in the EPROM to get the corresponding temperature values.

After the tenth set of readings, or 50 seconds after the thermostat has gone on, the program branches to another routine that is watching for the thermostat to turn off or the ignition transformer to turn off. If the ignition transformer voltage turns off first, then the program branches to a routine that waits for the thermostat to turn off. If the thermostat does not go off for 10 minutes, then a fault has been detected and the program branches to the FAULT DETECTED routine. If the thermostat does go off within 10 minutes, then the program returns to the top of the RECORD routine, which is waiting for the thermostat to go on.

During the RECORD routine, the LCD displays, real time, the time, the status of the thermostat, the ignition transformer voltage and the temperature on the outside of the vent stack pipe.

While there have been described what are presently considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A portable monitor and diagnostic apparatus for an oil burner, with said oil burner having a low voltage thermostat, and an ignition transformer, with both having a measurable voltage independent from each other, and with said oil burner further having a vent stack with a measurable temperature, said oil burner having an operational history comprising a sequence of on/off cycles and performance events within each on/off cycle, said apparatus comprising:

first sensing means for providing a first signal corresponding to the voltage at the thermostat of said oil burner;

second sensing means providing a second signal based on measuring the voltage at the ignition transformer of said oil burner;

third sensing means for providing a third signal corresponding to the temperature on the outside of the vent stack;

central processing means for processing said first, second, and third signals from said first, second and third sensing means, respectively, said central processing means providing an output of at least one signal corresponding to the performance events of said oil burner over a pre-selected time interval, said pre-selected time interval extending over a plurality of on/off cycles such that an operator can utilize said output from said central processing means to diagnose the operational history of said oil burner.

2. The monitor and diagnostic apparatus of claim 1 further comprising:

memory means for recording the output of said central processing means over the preselected time interval in the sequential order and timing corresponding to the performance events and sequence having occurred in said oil burner.

3. The monitor and diagnostic apparatus of claim 2 further comprising:

display means for displaying said recorded output of said memory means such that an operator of said apparatus can visually determine the operational history of said oil burner over the pre-selected time interval.

4. The monitor and diagnostic apparatus of claim 3 further comprising:

key pad means for accessing said recorded output stored in said memory means wherein the operator of said apparatus can review the sequence of performance events that has occurred over the pre-selected time interval.

5. The monitor and diagnostic apparatus of claim 4 wherein said central processing means processes said first signal and said second signal to provide a fault indicator signal and a time of occurrence if any one of the performance events of said oil burner during the pre-selected time interval results in a fault condition within said oil burner.

6. The monitor and diagnostic apparatus of claim 5 further comprising:

fault detecting means, activated by the fault indicator signal, for ceasing operation of said memory means and providing a fault alarm output signal that indicates to a downstream microprocessor that a fault has occurred.

7. The monitor and diagnostic apparatus of claim 6 wherein said second sensing means further comprises:

step down means for stepping down the voltage of the ignition transformer of said oil burner to a voltage below a threshold that could cause injury to a human.

* * * * *